United States Patent [19]

Fortenberry

[11] Patent Number: 4,563,813

[45] Date of Patent: Jan. 14, 1986

[54] CAM LOCK KNIFE STRUCTURE

[76] Inventor: Charles K. Fortenberry, Barlow Lake, Box 102, Woodville, Tex. 75979

[21] Appl. No.: 597,913

[22] Filed: Apr. 9, 1984

[51] Int. Cl.[4] ..... B26B 1/04

[52] U.S. Cl. ..... 30/161; 7/118

[58] Field of Search ..... 30/138, 157, 159, 160, 30/161; 7/118, 120, 162; 51/246; 83/174

[56] References Cited

U.S. PATENT DOCUMENTS

| | | | |
|---|---|---|---|
| 1,373,993 | 4/1921 | Boe | 30/161 |
| 1,706,581 | 3/1929 | McFarland | 7/162 |
| 2,304,601 | 12/1942 | Schrade | 30/159 |
| 2,316,655 | 4/1943 | Voos | 7/118 X |

FOREIGN PATENT DOCUMENTS

| | | | |
|---|---|---|---|
| 28514 | of 1910 | United Kingdom | 7/120 |

*Primary Examiner*—Douglas D. Watts
*Attorney, Agent, or Firm*—Phillip A. Rein

[57] ABSTRACT

This invention relates to a cam lock knife structure having (1) a main handle assembly; (2) a knife blade assembly pivotally connected to the main handle assembly and moveable from storage/folded condition to an open/usage condition; (3) a cam lock assembly engagable with a portion of the knife blade assembly to hold same rigidly in the usage and non-usage conditions; (4) a convey and actuator assembly operable to be attached to the cam lock assembly for ease of operation and for conveyance purposes; and (5) a sharpener lock assembly which can be utilized with the cam lock assembly to hold the knife blade assembly in various conditions and, additionally, independently removed for blade sharpening activities. The knife blade assembly includes a main support body having a cutting section and cam sections engagable with the cam lock assembly for holding the knife blade assembly in a rigid condition whether in the usage condition or folded non-usage condition. The cam lock assembly includes an elongated actuator lever member engagable, at one end, with the knife blade assembly and, at the other end, with a cam assembly to provide rigid locking features. The sharpener lock assembly is of rectangular shape having a main sharpener body whereupon portions thereof can be utilized for a cam locking feature and other portions for a knife blade sharpening surface. The sharpener lock assembly can be maintained within and carried by the main handle assembly. The invention herein includes the novel features of holding a knife blade assembly rigidly in the usage or storage positions which is important for paratroopers, combat troops, and the like.

1 Claim, 10 Drawing Figures

CAM LOCK KNIFE STRUCTURE

PRIOR ART

The applicant herein did not conduct a patentability search on the invention set forth hereinafter more specifically relating to a cam locking feature to hold a knife blade in both the open and closed positions.

However, the applicant has a pending U.S. patent application, Ser. No. 365,240, filed Apr. 5, 1982, which at this time has been allowed with seven (7) Claims therein. Time of the filing of this application, the subject pending application has not been printed.

The applicant's allowed application entitled "Folding Knife Structure" is more specifically drawn to a structure for holding a knife blade in a rigid condition when in the open usage position as indicated in FIGS. 1 and 3 of this pending application. The references cited against the applicant's pending application are not deemed pertinent to the invention claimed herein.

PREFERRED EMBODIMENT OF THE INVENTION

In one preferred embodiment of the invention, a cam lock knife structure is provided including a main support handle assembly; a knife blade assembly pivotally mounted in the main support handle assembly and operable to be folded from storage to usage conditions; a cam lock assembly engagable with a portion of the knife blade assembly to hold same in the usage and non-usage conditions; a convey and actuator assembly which is connectable to the cam lock assembly and aids in actuation thereof and for conveyance purposes on a belt member; and a sharpener lock assembly which can be releasably removed from the main support handle assembly and operable as a sharpening stone for the knife blade assembly. The main handle assembly resembles that of a conventional folding knife structure having spaced handle members interconnected by shaft members and having various spacing members adapted to achieve spacing for numerous knife blades or the like. The knife blade assembly includes a main support body having integral cutting section similar to a standard knife blade. The main support body is provided with a closed cam lock section and an open cam lock section operable to hold the same in respective locked and unlocked conditions. The cam lock assembly includes an actuator lever member held in the locked condition by a cam assembly. The actuator lever member is an elongated member including a main lever body having a cam blade section at one end and a cam section at the other. The main lever body is centrally mounted on a pivot pin. The cam blade section is engagable with the cam lock sections on the knife blade assembly to hold same in the desired positions. The cam section is engagable by the cam assembly on movement from usage and non-usage positions. The convey and actuator assembly includes a strap member connected to the cam lock assembly which, in turn, is connected to a conveyance member. The conveyance member is provided with a belt hook section for attachment to a belt member and a cutter section for skinning animals, removing clothing from injured persons, and the like. The sharpener lock assembly includes a main sharpener body having a main cam portion, a connector portion, and a pivot pin slot portion. The connector portion is adapted to be mounted about a pivot pin for holding same in a cam lock position. The main sharpener body is constructed of a sharpening material so that the entire sharpener lock assembly can be removed from the main support handle assembly and held in one hand to be used as a sharpening stone for the cutting section of the knife blade assembly.

OBJECTS OF THE INVENTION

One object of this invention is to provide a folding knife structure having a cam locking feature to hold a knife blade rigidly locked in both the open usage position and the folded blade storage position.

Still, another object of this invention is to provide a cam lock knife structure using a cam and lever principal to provide substantial locking force to a knife blade assembly both when in the usage and non-usage condition.

One other object of this invention is to provide a folding knife structure having unique cam lock features utilizing a lever principal to hold a knife blade in a rigid usage condition for obvious safety reasons.

Still, another object of this invention is to provide a folding knife structure having a cam lock sharpener lock assembly whereupon a knife sharpening plate can be readily attached to, removed from, and conveyed along with the entire knife structure so as to be available at any time for usage.

One other object of this invention is to provide a cam lock knife structure that is economical to manufacture, simple to use, having unique positive locking features, and substantially maintenance free.

Various other objects, advantageous, and features of the invention will become apparent to those skilled in the art from the following description, taken in conjunction with the accompanying drawings, in which:

FIGURES OF THE INVENTION

Figure 1:
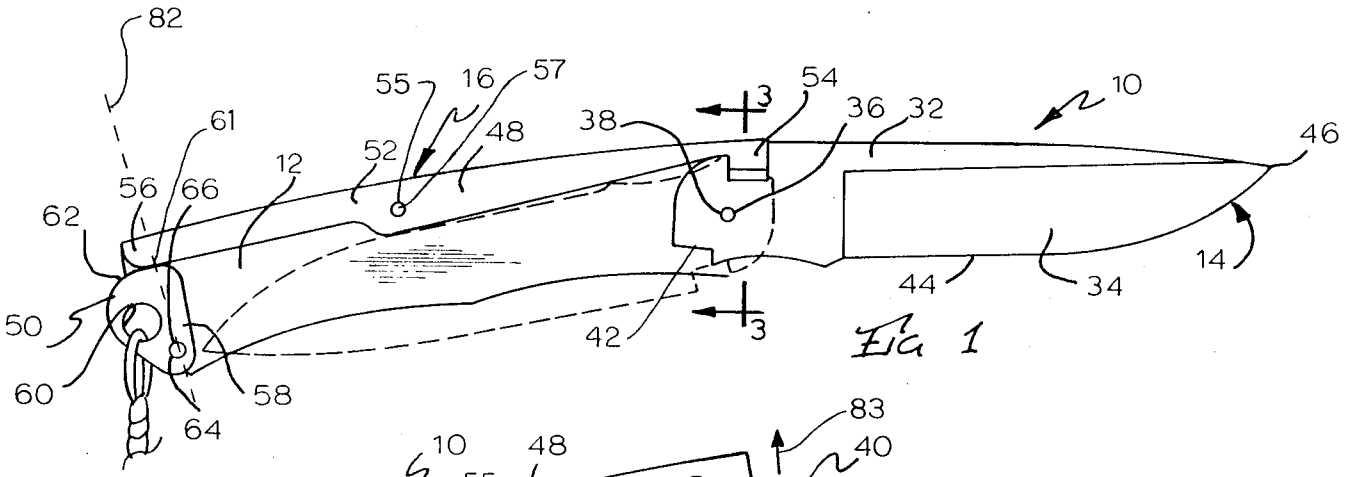
FIG. 1 is a side elevational view of the cam lock knife structure of this invention having portions thereof broken away for clarity and a knife blade assembly shown in the folded condition in dotted lines.

The following is a discussion and description of preferred specific embodiments of the new cam lock knife structure of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and in particular to FIG. 1, a cam lock knife structure, indicated generally at 10, includes (1) a main handle assembly 12; (2) a knife blade assembly 14 pivotally mounted on the main handle assembly 12; (3) a cam lock assembly 16 operable to be selectively engagable with the knife blade assembly 14 to hold same in both the closed/folded condition and the open/usage condition; (4) a convey and actuator assembly 18 connected to the cam lock assembly 16 for ease of operation thereof; and (5) a sharpener lock assembly 20 which can be selectively removed from the main handle assembly 12 to sharpen the knife blade assembly 14. The sharpener lock assembly 20 can be completely detached for usage or can be moved to a rigid, open position for sharpening other folding knife structures.

The main handle assembly 12 includes a pair of spaced handle members 22; connector members 24 interconnecting the spaced handle members 22; and spacer members 26 which may be added to the structure to provide the proper spacing when having numerous knife blade assemblies 14, can opener structures, screw drivers, etc. The spaced handle members 22 can be constructed of a material such as bone, tusks, steel, etc. to provide an attractive cam lock knife structure 10. The connector members 24 can be shaft members 28, rivet members, or the like operable to achieve an overall rigid structure.

The knife blade assembly 14 includes a main support body 32 integral with a cutting section 34. The main support body 32 includes a connector hole 36; a support shaft 38 mounted within the connector hole 36 for pivotal movement thereof; an open cam lock section 40; and a closed cam lock section 42.

Figure 3:
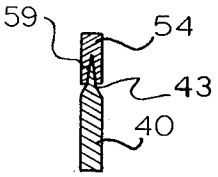
FIG. 3 is a sectional view taken along line 3—3 in FIG. 1.

The open cam lock section 40 is provided with a blade portion 43 which operates to provide the tapered connection shown in FIG. 3 and achieve rigid holding of the knife blade assembly 14 in the open condition. This is clearly set forth in the applicant's pending U.S. patent applicaion entitled Folding Knife Structure, Ser. No. 365,240, and filed Apr. 5, 1982. The closed cam lock section 42 is illustrated as having a flat surface portion 45 which is engagable with the cam lock assembly 16 in a manner to be explained.

The cutting section 34 is of a substantially conventionnal nature having an outer cutting edge portion 44 and a pointed end portion 46 resembling a conventional knife blade structure.

The cam lock assembly 16 includes an elongated actuator lever member 48 which is selectively engagable with a cam assembly 50. The actuator level member 48 includes a main lever body 52 having at one end a cam blade section 54 and, at the opposite end, a cam section 56.

The main lever body 52 is provided with a central hole 55 adapted to have a pivot pin member 57 mounted therein. It is noted that the main lever body 52 is pivoted about a central portion so as to achieve a substantial mechanical leverage force for locking the knife blade assembly 14 as will be explained. The cam blade section 54 is provided with a central slot 59 as shown in FIG. 3 to provided for self-adjusting locking feature as set forth in the applicant's pending U.S. patent application entitled Folding Knife Structure.

The cam section 56 is provided with a cam surface 61 which is engagable with the cam assembly 50 as will be explained.

The cam assembly 50 includes a main cam body 58 having a connector hole 60 therein and an outer cam surface 62. The cam surface 62 is adapted to be engagable with the cam surface 61 on the actuator lever member 48 in a manner to be explained. The connector hole 60 is adapted to be attached to the convey and actuator assembly 18 as will be explained. The main cam body 58 is provided with a connector hole 64 having a pivot pin 66 mounted therein for pivotal movement of the cam assembly 50.

Figure 2:
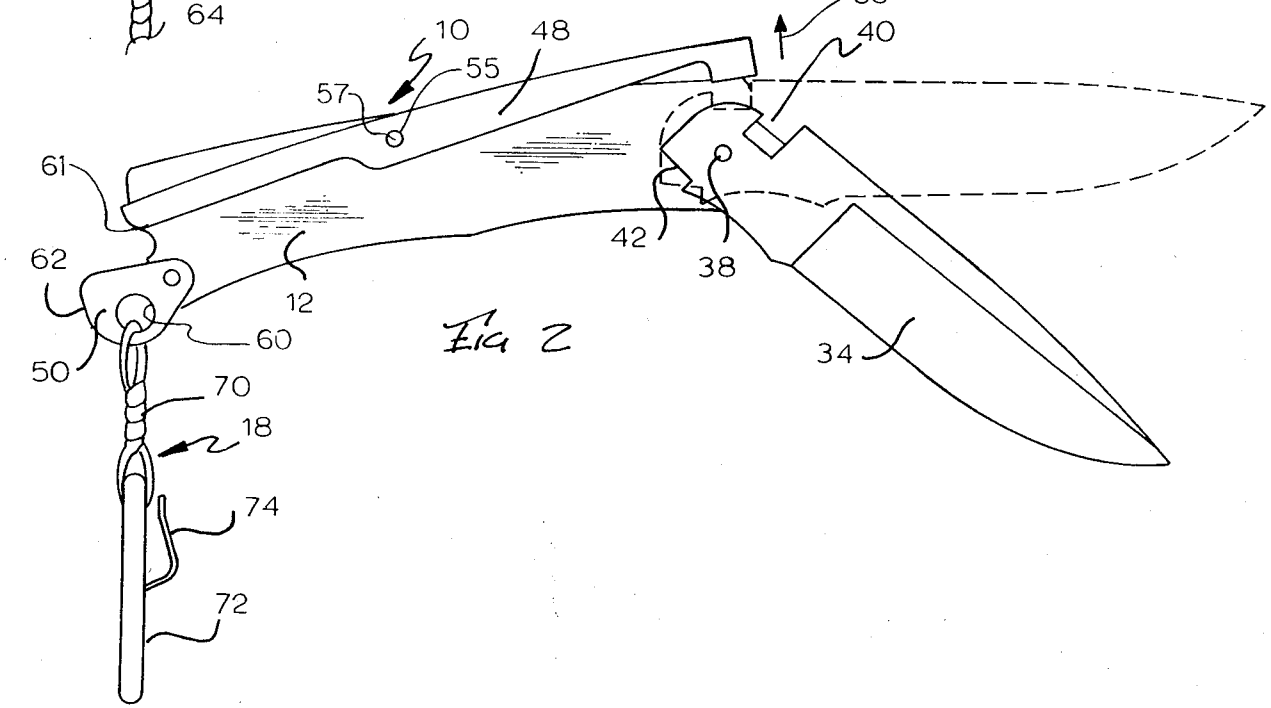
FIG. 2 is a view similar to FIG. 1 illustrating operation of the cam lock assembly of the cam lock knife structure of this invention.
Figures 5, 6, 7, 8, 9, 10:
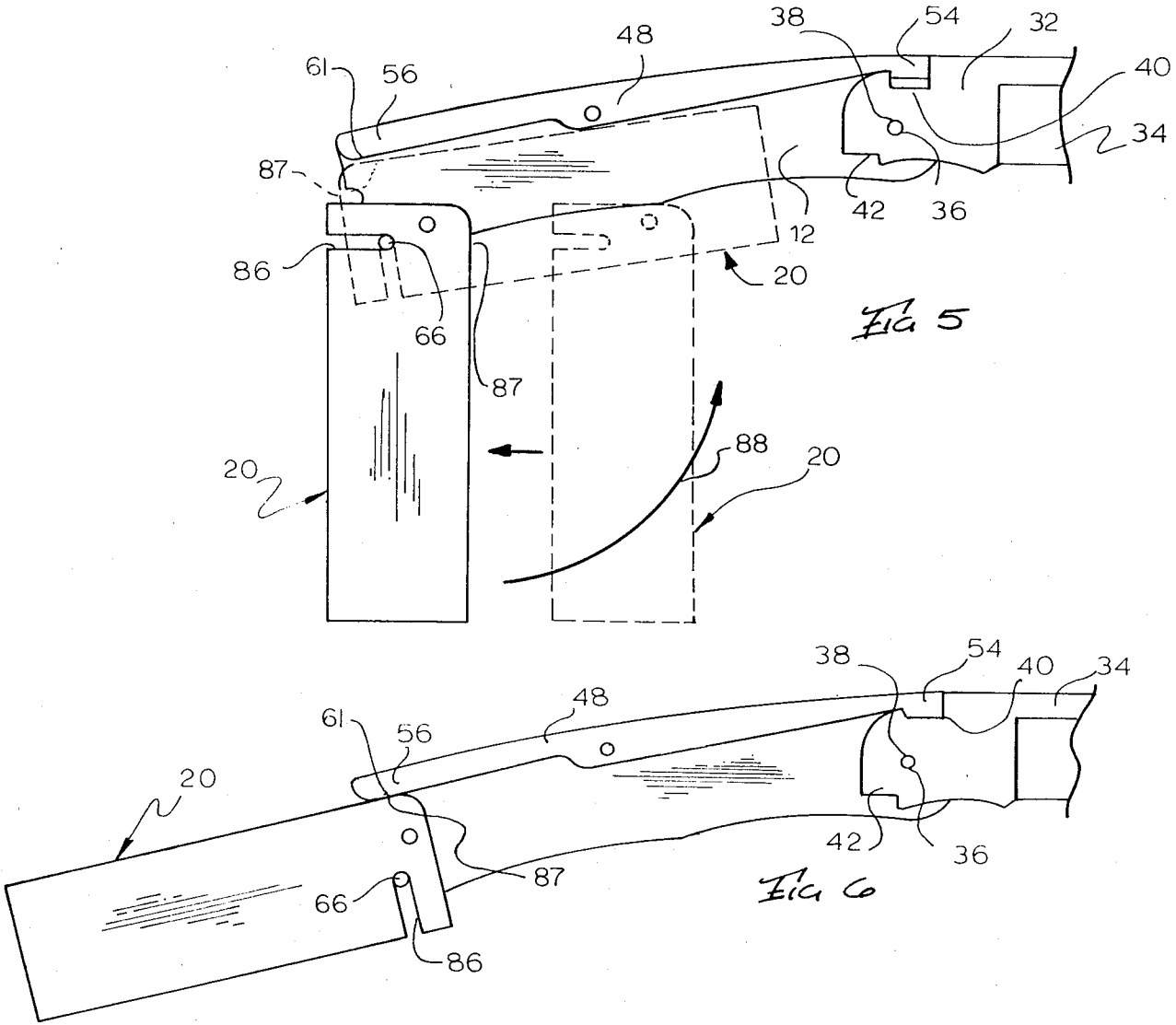
FIG. 5 is a fragmentary side elevational view of the cam lock knife structure of this invention having portions thereof broken away for clarity illustrating the use and operation of a removable sharpener lock assembly of this invention.
FIG. 6 is a view similar to FIG. 5 illustrating a sharpener lock assembly placed in a locked condition for the sharpening of a blade member on another folding knife structure.
FIG. 7 is a top elevational view of a conveyance member of the cam lock knife structure of this invention.
FIG. 8 is a side elevational view of the conveyance member.
FIG. 9 is a side elevational view of a sharpener lock assembly of the cam lock knife structure of this invention.
FIG. 10 is an end elevational view of the sharpener lock assembly.

As best shown in FIGS. 2, 7, and 8, the convey and actuator assembly 18 includes a strap member 70 having a conveyance member 72 connected thereto. The strap member 70 is a means of connecting the cam lock knife structure 10 to a support structure such as a persons belt member pocket, or the like. Additionally, the strap member 70 operates similar to a pull strap to move the cam assembly 50 to an unlocked position (FIG. 2) as will be explained.

As noted in FIGS. 7 and 8, the conveyance member 72 includes a belt hook section 74 integral with a cutter section 76. The belt hook section 74 is adapted to be hooked over the edge of one's pocket or belt member for conveyance and anchoring purposes.

The cutter section 76 is provided with a sharp blade portion 77 which is a very useful cutting tool for (1) removing clothing from injured persons; (2) removing skins from animals; etc.

Referring to FIG. 9, the sharpener lock assembly 20 includes a main sharpener body 80 having a cam portion 82; a connector portion 84; and a pivot pin slot portion 86. The main sharpener body 80 is preferably constructed of a special noncorroding, long lasting abrasive surface 85 which can be readily used to sharpen cutting sections 34 of knife blade assemblies 14 as will be explained. The cam portion 82 has a cam surface 87 operable to engage the cam surface 61 of the actuator lever member 48 as shown in FIGS. 5 and 6.

In FIG. 5 the sharpener lock assembly 20 as shown in the upper ones of dotted lines is serving as a cam locking feature similar to the cam lock assembly 50. In FIG. 6, the sharpener lock assembly 20 is shown in another locked position with the actuator lever member 48 so that additional folding knife structures can utilize the outer abrasive surface 85 thereof for sharpening of knife blades. The pivot pin slot portion 86 about the pivot pin 66 allows for the ready removal of the sharpener lock assembly 20 as shown in lower dotted lines in FIG. 5 for sharpening the knife blade assembly 14.

USE AND OPERATION

In the use and operation of the cam lock knife structure 10 of this invention on referring to FIGS. 1 and 2, the knife blade assembly 14 is shown in the open usage, and locked condition in solid lines in FIG. 1. More specifically, the actuator lever member 48 is held in the foremost upper position whereupon the cam assembly 50 engages the cam section 56 of the actuator lever member 48. At the same time, the outer cam blade section 54 is engagable with the open cam lock section 40 of the main support body 32 of the knife blade assembly 14 to hold same in a locked rigid condition.

In referring to FIG. 3, it is seen that in the above condition the V-shaped blade portion 43 of the open cam lock section 40 and the slot 59 of the cam blade section 54 provides a new and novel self-adjusting locking feature which has been claimed and allowed in the applicant's pending application, entitled Folding Knife Structure, Ser. No. 365,240, filed Apr. 5, 1982.

It is noted that the distance from the cam surface 62 inwardly to the pivot pin 66 is such as to achieve the rigid connection along an axis indicated at 82 where the force lines are directly in a common plane so as to hold the acutator lever member 48 under flexible pressure for a positive lock feature. In fact, the strap member 70 is necessary in order to move the cam assembly 50 to the unlatched condition of FIG. 2 due to the spring pressures involved between the acutator lever member 48 and the cam surfaces 62 and 61.

Next, on initial movement to the unlocked condition, the cam assembly 50 is pulled outwardly by the strap member 70 as shown in FIG. 2 which allows the cam blade sections 54 of the actuator lever member 48 to move upwardly as shown by the arrow 83 in FIG. 2. This allows the knife blade assembly 14 to pivot about the support shaft 38 from the dotted line in position in FIG. 2 to that shown in solid lines.

Next, the knife blade assembly 14 continues to move in a clockwise direction as viewed in FIG. 2 to the dotted line position in FIG. 1. Thereupon, the cam assembly 50 is moved upwardly by thumb pressure so as to once again achieve the solid line position shown in FIG. 1. However, in this condition, it is noted that the closed cam lock section 42 on the knife blade assembly 14 is engagable with the cam blade section 54. This positively locks the knife blade assembly 14 in the folded position as shown in dotted lines in FIG. 1. This is very important for persons like parachutists, combat troops, and anyone who is in danger of the knife blade assembly 14 unintentionally or unwantedly moving to the open condition whereupon it could cut ones leg, force the blade into the abdomen, etc.

Figure 4:
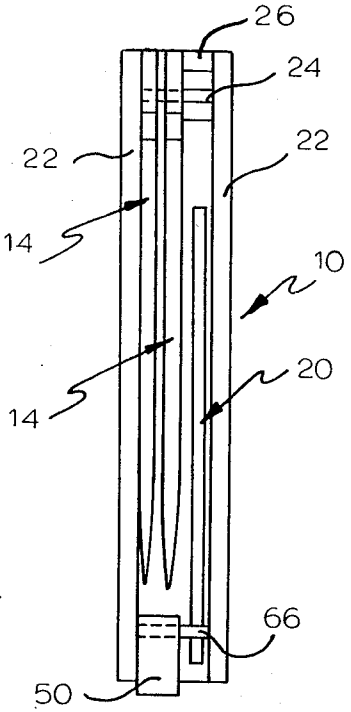
FIG. 4 is a bottom plan view of a cam lock knife structure of this invention illustrated with two knife blade assemblies and a sharpener lock assembly.

As noted in FIG. 4, it is obvious that the structure as described in FIGS. 1 and 2 can be repeated as often as practical and the entire cam lock knife structure 10 as shown in FIG. 4 consists of the knife blade assemblies 14 along with a sharpener lock assembly 20.

As noted in FIGS. 9 and 10, the sharpener lock assembly 20 is an independent element which can be constructed to act as a cam member as shown in FIG. 5 co-acting with the actuator or lever member 48. The sharpener lock assembly can be removed to act as a sharpening stone structure as indicated in FIG. 6. More particularly, the sharpener lock assembly 20 is of a flat rectangular plate construction having the outer surface 85 constructed of an abrasive material which is non-corrosive and very effective in sharpening high quality knife blade assemblies 14.

In referring to FIG. 5, the sharpener lock assembly 20 is shown in the upper dotted lines as being utilized similar to the cam assembly 50 in that a cam portion 87 engages the cam section 56 on the actuator lever member 48. This locks the knife blade assembly 14 in the usage condition as described for the structures illustrated in FIGS. 1 and 2. It is obvious that the same features shown in FIG. 5 can be utilized to hold the knife blade assembly 14 in the closed/folded condition similar to that as described in the dotted lines of the knife blade assembly 14 as set forth in FIG. 1.

As noted in FIG. 5, the sharpener lock assembly 20 can be pivoted downwardly to the position shown in solid lines as indicated by the arrow 85, next, the sharpener lock assembly 20 can be moved laterally as indicated in the lower dotted lines in FIG. 5 and completely removed from the rest of the cam lock knife structure 10.

Next, the sharpener lock assembly 20 can be mounted through the pivot pin slot portion 86 on the pivot pin 66 and moved upwardly into the locked condition of FIG. 6. When this happens, both the knife blade assembly 14 and the sharpener lock assembly 20 are held in a rigid condition. This allows one to grasp the main handle assembly 12 and utilize the sharpener lock assembly 20 to sharpen an additional independent folding knife structure which is an important feature of the invention.

It is obvious that the sharpener lock assembly 20 can be independently carried within the main handle assembly 12 as shown in the embodiment of FIG. 4 and removed therefrom for sharpening purposes and not be associated with a respective knife blade assembly 14 if so desired. However, it is obvious that the sharpener lock assembly 20 can be used as a cam locking feature as shown in FIG. 5 whereupon the cam assembly 50 would not be necessary for this particular portion of the entire cam lock knife structure 10.

It is seen that the cam lock knife structure of this invention is economical to manufacture; easy to operate; provided with positive knife blade assembly locking features; and substantially maintenance free.

While the invention has been described in conjunction with the preferred specific embodiments thereof, it would be understood that this specification is intended to illustrate and not to limit the scope of the invention, which is defined by the following claims.

I Claim:

1. A cam lock knife structure, comprising:

(a) a main handle assembly;

(b) a knife blade assembly pivotally mounted to one end of said main handle assembly and movable from a folded, storage position to an open, usage position;

(c) a cam lock assembly including an actuator lever member pivotally connected to said main handle assembly and a cam assembly pivotally mounted at another end of said main handle assembly;

(d) said actuator lever member having a cam blade section engagable with a portion of said knife blade assembly in both the folded and open positions and a cam section engagable with said cam assembly to rigidly anchor said knife blade assembly both in the folded and open positions against movement;

(e) said cam blade section of V-shape in transverse crosssection adapted to contact a similarly shaped but reverse portion of an open cam lock section of said knife blade assembly so as to hold same rigidly in the open/usage position;

(f) a convey and actuator assembly attached to said cam lock assembly operable to aid in movement of said cam lock assembly from the closed actuated position to an open released position;

(g) said convey and actuator assembly is attached to a portion of said cam assembly so as to aid in the movement thereof from a latched and unlatched position;

(h) said convey and actuator assembly includes a strap member which is secured to said cam assembly and a conveyance member;

(i) said conveyance member having a hook section which is engagable with a porion of one's pocket or belt structure; and (j) said conveyance member including a cutter section which is operable for slicing thin material such as a person's clothing for removing same during an emergency.

* * * * *